United States Patent [19]

Madsen

[11] Patent Number: 4,944,227

[45] Date of Patent: Jul. 31, 1990

[54] RAIL TRANSPORTATION SYSTEM WITH SWITCHES

[75] Inventor: Holger Madsen, Skjern, Denmark

[73] Assignee: ALFA-Laval Agri Scandinavia A/S, Skjern, Denmark

[21] Appl. No.: 264,278

[22] PCT Filed: Feb. 18, 1988

[86] PCT No.: PCT/DK88/00029

§ 371 Date: Oct. 20, 1988

§ 102(e) Date: Oct. 20, 1988

[87] PCT Pub. No.: WO88/06206

PCT Pub. Date: Aug. 25, 1988

[30] Foreign Application Priority Data

Feb. 20, 1987 [DK] Denmark ..... 862/87

[51] Int. Cl.[5] ..... E01B 25/26; B61B 3/00; B61L 5/02

[52] U.S. Cl. ..... 104/103; 104/88; 246/415 R; 246/323

[58] Field of Search ..... 104/103, 88, 96, 98, 104/103, 100, 123, 130–132, 91; 105/155, 156; 246/323, 264, 415–419

[56] References Cited

U.S. PATENT DOCUMENTS 1,392,188 9/1921 Arlin et al. ..... 246/323

3,503,336 3/1970 Heiberg ..... 104/103

4,016,818 4/1977 Ellzey ..... 104/103

FOREIGN PATENT DOCUMENTS 8806206 8/1988 World Int. Prop. O. ..... 104/103

*Primary Examiner*—Douglas C. Butler

*Attorney, Agent, or Firm*—Antonelli, Terry, Stout & Kraus

[57] ABSTRACT

In overhead rail systems with branching tracks, a carrier such as a feeding container can be brought to pass a cyclic transportation course when the pertaining switches are correctly operated. By the invention the carrier (8, 6) and the switches (10) are arranged in such a manner that a predestined transportation course is automatically achieved without applying any separate control of the switches, as the carrier (6) is provided with switchable activation cams (22), which can cooperate with change-over switch arms (26, 28) on each rail switch (10) in such a manner that the carrier (6) by its own movement can cause a change-over of the switch (10), when this is relevant, as the activation cams (22) selectively are made operative and inoperative, respectively, by passing strategically placed, fixed actuator members (30, 32). Hereby a cyclic course of the conveyance of the carrier can be arranged purely mechanically.

5 Claims, 1 Drawing Sheet

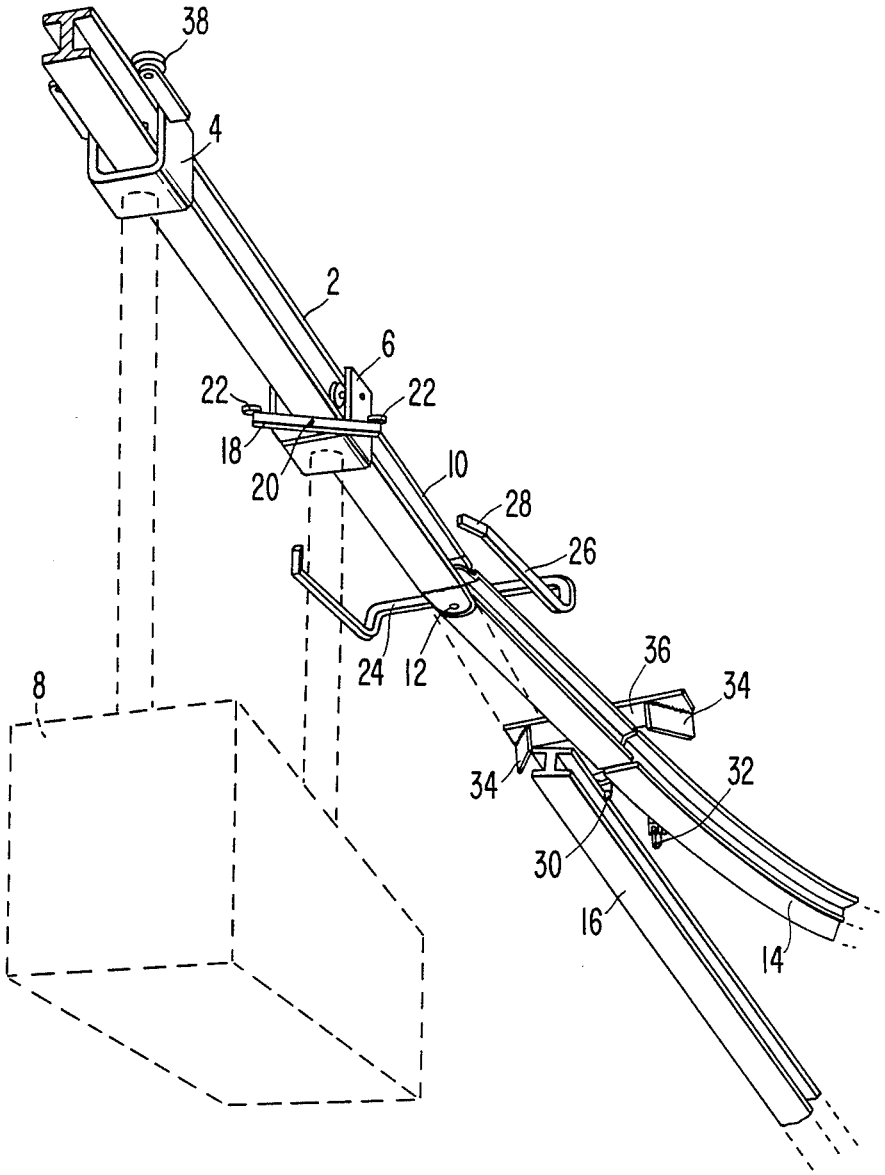
38
4
2
6
22
22
18
20
10
28
26
24
12
36
34
8
34
32
30
16
14

RAIL TRANSPORTATION SYSTEM WITH SWITCHES

Field of the Invention

1. Background and Summary of the Invention

The present invention relates to a rail switch system for overhead monorail transportation systems, e.g. for feeding systems where one or more trolleys for a suspended load are moved along a system of carrier rails having one or more associated switches. In a branched distribution system it is customary that separately controlled means for changing over the switches are provided, these means being perfectly well controllable from such a control equipment which should be used anyway for controlling the movements of the trolley or trolleys and optionally for portioning out fodder at the individual feed points.

For the invention it is a fundamental concept, however, that both the control equipment and the control means for the switches can be substantially simplified in such cases, where the sequence of operations in the transportation system itself is strictly regular, such that the switches should not be fully selectively activated but activated in a predetermined way relative to the occurring passage or passages of the trolley. This, by way of example, will normally be the case in feeding systems where a hanging carrier at each feeding sequence is moved from a loading station out along a main rail which communicates with one or more branch rails, along which the carrier has to be moved out and thereafter back again for further travel along the main rail to possible further branches and thereupon back along the main rail to the loading station. Hereby it is a given condition that the first switch, which the carrier will meet after its exit from the loading station, must be activated for exit of the carrier along the branching rail and that the carrier can go back to the main rail to a position behind the switch and from there be restarted for passing the now changed over switch, for further travel along the main rail, by-passing the branch rail. The invention is hereby based on the finding that the necessary changing-over of the switch can be regarded as a function of the actual sequences of operation of the carrier and that the changing-over of the switch, therefore, can be effected by the carrier itself or by suitable actuator members placed in connection with the carrier suspension as these members can cooperate with corresponding activation means on the switch in such a manner that the rail switch by the initial entrance of the carrier—after its preceding reversal along the main rail—is changed-over to correspondence with the branch rail, while by the next entrance of the carrier, viz. upon return of the carrier from the branch, it is activated by the forward-running carrier itself to be changed-over to correspondence with the main rail.

Such a predetermined change-over can be effected by means of simple mechanical engagement means which can be activated by the actual forward running movement of the carrier, i.e. without separately controlled and activated change-over actuators when only a change-over between forward and reverse travel of the carrier can be effected.

In a sense this is quite a simple principle, but in practice it has been extremely difficult to provide a correspondingly simple solution to the associated control problem.

The invention not only provides a solution to the problem, but even a quite simple and economically advantageous solution which is based on the concept that the trolley is provided with mechanically changeable activation means designed to cooperate with abutment portions mounted fixedly on and backwardly protruding from the switch rail in such a manner that the activation means all according to its setting can activate the switch rail to pivot to changing the rail, respectively omit such an activation of the switch rail, all dependent on a forward travel of the trolley towards the switch - or preferably - dependent on a reverse travel of of the trolley after a backwards passage along the switch rail, while in places along the adjoining rail parts abutment members are provided for changing-over of the said activation means by the passing of the carrier past these abutment members in such a manner that the carrier by an immediately repeated forward travel along a switch will be re-routed to the other of the connected rails.

The carrier can hereby by an outwardgoing travel from e.g. a fixed loading station be brought to solve its task by a run out on and back from a branch rail and thereafter by a further run forwardly along a main rail with possible further branches and finally back to the loading station. En route it is only to be seen that the carrier or trolley runs through positions where fixed abutments change-over the activation means in a relevant manner.

The invention is explained in the following with reference to an embodiment example shown in the drawing.

Brief description of the Drawings

The single drawing figure is a view from below and to one side of an overhead rail system according to the invention.

Detailed Descriptions Of The Disclosed Embodiment

In the drawing is shown an overhead rail system with a main rail part 2 carrying two trolleys 4 and 6 for an indicated suspended carrier 8. By way of example it can be a feeding system, where the main rail 2 leads (backwards) to a carrier loading station, or where the carrier already in the position shown is situated adjacent to a loading equipment whereby the rail 2 may not have to reach further backwards. From this position the carrier can run forward to a switch in the form of a rail length 10 that is pivotable around a vertical pivot 12 for connecting the main rail 2 either to a branch rail 14 or to a rail 16 which can be an extended main rail from which one or more branchings off to rail branches corresponding to the rail 14 may occur.

For the system a predetermined control routine is laid down which in the actual example being that the carrier 8 at each cycle must run (1) from the main rail 2 out onto the branch rail 14, (2) back from the branch rail 14 onto the main rail 2, (3) from the main rail 2 out onto the extended main rail 16, (4) possibly from this rail out onto one or more branch rails which, however, will correspond entirely to the situation represented by the switch as already shown and as described in more detail below.

(5) and eventually back from the rail 16 to the main rail 2.

Based on this predetermined operation cycle it is possible to take advantage of the fact that the carrier itself can cause a mechanical change-over of the switch, when the carrier is moved either forwardly or backwardly in the pertinent area, as all that is required is ensuring a correct, desired position of the switch at the initial entrance of the carrier. The change-over to the succeeding exit along the other rail can then take place controlled by the movement of the carrier either in connection with the reverse run across the area or in connection with the repeated entrance, as by the initial entrance or by the reverse run it is possible to effect a change-over of such activation means, which will thereafter cause a change-over of the switch by the next entrance, or by the reverse run a change-over of the rail length 10 can be brought about in such a manner that at the next entrance it just assumes its changed over, correct position.

By the illustrated, practical embodiment the latter solution is in fact applied, as for the situation shown in FIG. 1 it is assumed that the carrier 8 has just returned from the rail part 16 and has thereby caused a change-over of the rail length 10 such that the latter is now ready to take the carrier along the branch rail 14. When the carrier returns from this rail a change-over from the rail length 10 to the rail 16 must consequentially be effected, and this is done as follows:

In connection with the front trolley 6 is placed a cross bar 18 which at either end protrudes beyond the trolley and is tiltable on a horizontal axle pivot 20 extending in the running direction of the trolley. At its opposite ends this cross or tilt bar 18 is provided with partly protruding, horizontal wheels 22, and between the trolley 6 and the tilt bar 18 are inserted spring lock members, not shown, allowing the tilt bar 18 to be tilted between the shown oblique position and an opposedly tilted oblique position, but otherwise securing the tilt bar against uncontrolled tilting away from these positions, in which the wheels 22 are situated in well-defined, mutually different height positions, between which they are shiftable by tilting the tilt bar 18.

On the rail length 10 a cross arm 24 is fastened near the former's hinged end, the outer ends of the cross arm being extended rearwardly in arm parts 26, each ending in a horizontally obliquely inwards projecting guiding part 28. These guiding parts 28 are situated at a height corresponding to the height position occupied by the one wheel 22 of the tilt bar 18 being at the upward tilted end of this bar while the height dimension of the guiding parts 28 is sufficiently small for these parts to be located entirely above the level of the wheel 22 at the lowered end of the tilt bar 18.

The transverse distance between the outer ends of the guiding parts 28 suffices or can suffice for the tilt bar 18 with its protruding wheels or rollers to pass freely between these ends when the rail length 10 is at its intermediate position between its two switch positions, but as the guiding parts 28 by a pivoting of the rail stretch 10 from this centre position will get closer or father away, respectively, from the vertical centre plane of the main rail 2, the situation will arise that the raised roller 22 by the reverse run of the carrier 8 will engage with the guiding part 28 at the pertinent side and thereby force this guiding part outwards, while the opposite, lowered roller 22 will completely evade the opposite guiding part 28, i.e. be inoperative. Such a pressure outwardly on the pertinent guiding part 28 will cause a pivoting of the rail stretch 10 to the opposite side, and the geometry of the system is such that the rail length 10 is hereby pivoted to align with the opposed rail parts 14 or 16, respectively.

It is hereby essential that the tilt bar 18 takes a correctly tilted position to one side or the other, but this can be ensured by quite simple and fixed mechanical means, viz. ceiling mounted abutment rollers 30 and 32 placed at either one or the other side of the respective rails 14 and 16 in such a manner that these rollers will be run into by the raised end of the tilt bar 18 and thereby provoke in the manner of a cam a tilting down of this end and consequently a change-over of the tilt bar.

In the example of FIG. 1, it is assumed that the carrier in the previous cycle returned to the position shown from the rail part 16, whereby the tilt bar 18 during the reverse passage of the abutment roller 32 was tilted to the oblique position shown, unless the tilt bar already before this passage happened to be in this position. The rail stretch 10 was pivoted to connection with the rail part 16, i.e. the left guiding part 28 was situated pivoted to connection with the main rail 2. After the trolley 6 passed onto the rail 2, the left guiding part 28 was hit by the raised roller 22, which pushed the guiding part outwards resulting in the rail stretch 10 being pivoted over to the position shown in engagement with the branch 14. Simultaneously the right hand guiding part 28 was pivoted inwards towards the rail 2, but without being able to engage the lowered roller 22.

As the illustrated positions of the guiding parts 28 thus will be a consequence of the previous return run of the carrier 8 or the trolley 6, it will, of course, when a repeated entrance occurs, be possible to move the carrier unobstructedly past the guiding parts, i.e. the carrier will as required run forward along the rail stretch 10 onto the branch rail 14. The abutment roller 30, which is placed to the left of the branch rail somewhere therealong, will at the passing of the trolley 6 push the raised end of the tilt bar 18 downwards and thereby change over the tilt bar.

When the carrier later returns from the branch rail, the oblique position of the tilt bar will consequently be the converse of the position shown, and therefore the swung in right-hand guiding part will be pushed outwards by the now raised right-hand roller 22, whereby the rail stretch 10 is pivoted to correspond with the rail part 16.

At a repeated forward drive of the carrier, cf. the operation schedule drawn up, the carrier will then run onto the rail part 16, from where it may possibly be run to a variety of further branches controlled by exactly the same switching principle. It is significant, however, that the tilt bar 18 at the return of the carrier to the loading station takes up or is changed over to the position shown such that it can again cause a change-over of the rail stretch 10 to the illustrated connection with the branch rail 14, and this possibly necessary change-over of the tilt bar 18 will be effected by the shown abutment roller 32.

For the system disclosed it is a condition that the tilt bar 18, upon return of the carrier 8 through a switch, should not be changed over if the carrier thereafter is to run through the switch again, as the raised end of the tilt bar would then collide with the inwardly pivoted guiding part 28, but this condition is easily observed when only the operation cycle has been laid down from the outset.

As for all rail switches it is also a condition, of course, that the rail length 10 is left in continuation of the rail 14 or 16 which the carrier has entered and has to return from. For reasons of security it is preferred here to apply a mechanism, which will ensure guiding the rail stretch to a correct position at the return run of the carrier, whereby special locking devices for the rail stretch will not be required. This mechanism consists of a pair of catch plates 34 mounted obliquely to the longitudinal direction. These plates protrude downwards at either side from a fixed, transverse girder 36 on the rail stretch near the free end of the latter and cooperate with a pair of horizontal catch rollers 30 placed at either side of the rear trolley 4 near its upper end, such that the catch wheels, which can just pass through the area between the inner ends of the catch plates 34, as far as one of these wheels is concerned will hit one of the catch plates at the reverse run of the carrier in case the rail length is not at its exact position. Such an engagement will force the actual catch plate outwardly by the pertinent roller 38 during a related pivoting of the rail stretch 10 resulting in the latter being correctly positioned at the moment the trolley 4 enters it. The catch plates should preferably cover extensively enough to ensure a correct pivoting in of the rail stretch even though the end of this rail stretch at the return of the carrier is situated even as far away as at the other rail part, regardless of how such an inadvertent change-over has arisen.

In the disclosed system the change-over of the switch rail 10 is effected by the reverse run of the carrier 8 or the trolley 6. However, nothing prevents that a corresponding change-over could be effected in connection with the forward travel of the carrier or the trolley provided only that the catch parts 28 cooperate with the forwardly moved rollers 22, the position of which in that case should be changeable, e.g. depending on the trolley being reversed towards a special change-over stop or is stopped before such an extensive reversal.

The system can also be modified such that the backwardly protruding arms 26 on the rail stretch 10 can be substituted by forwardly protruding arms on the trolley 6 so that the trolley 6 selectively can perform a change-over effect on the rail stretch 10 immediately before it enters this rail stretch.

It should be noted that for certain systems, e.g. for transport of individual items in a production sequence, an outside intervention into the determined operation program might be desirable and that it here would be a relatively simple arrangement to let the activation rollers 30, 32 be changeable between a normal, operative position and a raised or an outwardly pivoted non-operative position; by way of example the brackets of the rollers might be pivotable to an inoperative position by remote control by a simple cord drive. Correspondingly, normally inoperative activation rollers could be placed at the respective opposite sides of the rails.

It will be appreciated that the arrangement shown may to a large extent be modified by applying "reverse" control principles, e.g. by using forwardly protruding activation arms on the carrier instead of backwardly protruding arms on the switch rail.

I claim:

1. A rail transportation system comprising at least one rail switch having a switchable rail member which is switchable for connecting different rail sections of the system and at least one carrier which is controlled to operate according to a predetermined program, said carrier and said rail member being provided with cooperating engagement means for effecting relevant shifts of the rail member by a force derived from the motion of the carrier, said engagement means of said carrier being selectively shiftable between an operative and a non-operative position, the system further comprising actuator means operable to selectively shift these engagement means between said positions for enabling the carrier to carry out movements in the system in accordance with the predetermined program, and wherein said actuator means are constituted by fixed abutment members mounted at selected places along rail section of the system for cooperation with the engagement means of the moving carrier in such a manner that he carrier, when moved forwardly and rearwardly in the system in a controlled, preprogrammed manner, interacts with the said abutment members to the effect that the carrier is thereby automatically controlled to move in compulsory accordance with the predetermined program.

2. A system according to claim 1, wherein the engagement means of said rail member includes an arm member provided at each side of the switchable rail member, which arm members project rearwardly past a pivot axis area of the rail member and terminate in horizontally inwardly oblique guiding portions, and wherein the engagement means on said carrier includes a transverse pivot lever which is pivotable between two symmetrical positions, in which only one or the other end of the lever is located level with the guiding portions and assumes a lateral position, in which it is operable to displace the corresponding guiding portion of the switchable rail member by the passage of the carrier, if that guiding portion happens to be located swung into the motion track of the pivot lever end, said abutment means being constituted by cam members mounted selectively at one side or the other of fixed rail sections leading away from the rail switch.

3. A system according to claim 1, further comprising catching means mounted on the switchable rail member adjacent a free end thereof for cooperation with corresponding activator means provided on the carrier so as to ensure that the switchable rail member is pivoted into a correct position just before the carrier arrives at the switchable rail member from one of an adjoining rail sections.

4. A rail transportation system according to claim 1, wherein said system is a overhead monorail system.

5. A rail transportation system according to claim 1, wherein said carrier includes at least one trolley mounted for movement on the rail transportation system.

* * * * *